US007048551B2

(12) United States Patent
Takayama

(10) Patent No.: US 7,048,551 B2
(45) Date of Patent: May 23, 2006

(54) WIRE END PORTION-PRESS FASTENING STRUCTURE

(75) Inventor: Tsutomu Takayama, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/101,546

(22) Filed: Apr. 8, 2005

(65) Prior Publication Data

US 2005/0227550 A1 Oct. 13, 2005

(30) Foreign Application Priority Data

Apr. 9, 2004 (JP) ..... P2004-115546

(51) Int. Cl.
*H01R 12/00* (2006.01)

(52) U.S. Cl. ..... 439/67; 439/851

(58) Field of Classification Search ..... 439/67, 439/851–854, 848
See application file for complete search history.

(56) References Cited

U.S. PATENT DOCUMENTS

| | | | | |
|---|---|---|---|---|
| 2,163,771 | A * | 6/1939 | Milton | 439/851 |
| 5,217,397 | A * | 6/1993 | Itoh | 439/865 |
| 5,743,770 | A * | 4/1998 | Hamai | 439/752.5 |
| 5,785,560 | A * | 7/1998 | Akamatsu | 439/851 |
| 6,334,798 | B1 * | 1/2002 | Ushijima et al. | 439/879 |
| 6,656,002 | B1 * | 12/2003 | Zhao et al. | 439/851 |

FOREIGN PATENT DOCUMENTS

| | | |
|---|---|---|
| JP | 11-3733 A | 1/1999 |
| JP | 2000-251961 A | 9/2000 |

* cited by examiner

*Primary Examiner*—Michael C. Zarroli
(74) *Attorney, Agent, or Firm*—Sughrue Mion, PLLC

(57) ABSTRACT

A wire end portion-press fastening structure for press-clamping a conductor of a wire to a conductor press-clamping portion of a press-clamping terminal in electrically-connected relation thereto. The press-clamping terminal has conductor press-fastening piece portions, and the conductor of the wire is bent back to provide a double portion. The double portion is press-fastened to the conductor press-clamping portion by the conductor press-fastening piece portions through an electrically-conductive press-clamping member.

8 Claims, 7 Drawing Sheets

WIRE END PORTION-PRESS FASTENING STRUCTURE

BACKGROUND OF THE INVENTION

This invention relates to a wire end portion-press fastening structure used for electrically connecting a conductor of a wire to a press-clamping terminal.

There is known one related wire end portion-press fastening structure for electrically connecting a conductor of a wire to a press-clamping terminal, in which an electrically-conductive member is provided (see, for example, Patent Literature 1).

In the wire end portion-press fastening structure disclosed in Patent literature 1, the press-clamping terminal 70 includes an electrical contact portion 71, and a wire press-clamping portion 72 as shown in FIG. 10. The wire press-clamping portion 72 includes a conductor press-clamping portion 75 for press-clamping the conductor 74 of the wire 73, and a sheath press-clamping portion 77 for press-clamping a sheath 76 of the wire 73. The narrow electrically-conductive member 78 is provided at the conductor press-clamping portion 75, and extends over an entire width thereof. The electrically-conductive member 78 fills in a gap, formed between the conductor press-clamping portion 75 and the conductor 74 during the press-clamping operation, in a gastight manner.

There is known another related wire end portion-press fastening structure for electrically connecting a conductor of a wire to a press-clamping terminal, in which serrations are formed at a wire barrel portion (see, for example, Patent Literature 2).

In the wire end portion-press fastening structure disclosed in Patent Literature 2, the press-clamping terminal 80 includes the wire barrel portion 82 and an insulation barrel portion 84 which are formed integrally with each other, and are juxtaposed in a direction of a length of a terminal body 81. The conductor 86 and a sheath end portion 87 of the wire 85 are press-clamped respectively to the two barrel portions 82 and 84, and therefore are connected thereto. The plurality of parallel serrations 88 are formed at the wire barrel portion 82, and extend in one direction. The serrations 88 prevent the conductor 86 of the wire 85 and the wire barrel portion from being displaced relative to each other at areas of contact between the inner periphery of the wire barrel portion 82 and the conductor 86 during the time when the conductor 86 of the wire 85 is connected to the wire barrel portion 82 by press-clamping.

Patent Literature 1: JP-A-2000-251961 (Pages 2 to 3, FIG. 1)

Patent Literature 2: JP-A-11-003733 (Pages 2 to 3, FIG. 1)

When a conductor of a wire is electrically connected to a press-clamping terminal by press-fastening (press-clamping), a mechanical strength of the press-fastened conductor usually decreases to a level lower than a breaking strength of the conductor. Here, whether the conductor is made of copper or aluminum, the degree of decrease of the mechanical strength thereof is generally the same. However, the aluminum conductor is lower in breaking strength than the copper conductor, and therefore there is a fear that the aluminum conductor cannot withstand an applied force when a wire harness is assembled. Namely, there is a fear that the aluminum conductor is cut during the press-fastening (press-clamping) operation since the aluminum conductor is relatively low in strength, and therefore it is desired that the aluminum conductor will not be squeezed during the press-fastening operation. However, unless the aluminum conductor is adequately squeezed, there arises a problem that the area of contact of the conductor decreases, so that the electrical resistance increases.

Therefore, when the conductors 74 and 86 in the above Patent Literatures 1 and 2 are made of aluminum, there is countered a problem that the area of contact of the conductor decreases, so that the electrical resistance increases, which makes it difficult to flow an electric current of a predetermined value through the wire.

SUMMARY OF THE INVENTION

This invention has been made in view of the above circumstances, and an object of the invention is to provide a wire end portion-press fastening structure that can increase a contact area so as to decrease an electrical resistance.

(1) A wire end portion-press fastening structure comprising:

a wire that includes a conductor, wherein an end portion of the conductor is bent back so as to provide a double portion;

a press-clamping terminal, the press-clamping terminal comprising:

a conductive press-clamping terminal body;

an electrical connecting portion that is disposed at an end portion of the press-clamping terminal body, and is connected to a mating terminal;

a conductor press-clamping portion that is deposed at a portion corresponding to the double portion; and conductor press-fastening piece portions that are extended from opposite sides of the conductor press-clamping portion in an axial direction; and a conductive press-clamping member that is held in contact with the conductor, wherein the conductor press-fastening piece portions is press-fastened to the press-clamping member, so that the double portion is electrically connected to the conductor press-clamping portion through the press-clamping member.

(2) The wire end portion-press fastening structure according to (1), wherein the press-clamping member has a hole and a pipe shape.

(3) The wire end portion-press fastening structure according to (1), wherein the press-clamping member includes a top plate that has a generally semi-cylindrical shape, and a bottom plate that is integrally connected to opposite side edges of the top plate.

(4) The wire end portion-press fastening structure according to (1), wherein an axial length of the press-clamping member is substantially equal to an axial length of the conductor press-fastening piece portion.

(5) The wire end portion-press fastening structure according to (1), wherein the wire includes a sheath that covers the conductor, and the press-clamping terminal includes sheath press-fastening piece portions that are extended from opposite sides of a portion opposed to the electrical connecting portion of the press-clamping terminal body in the axial direction, and wherein the sheath press-fastening piece portions are press-fastened to the sheath.

(6) The wire end portion-press fastening structure according to (2), wherein the double portion includes a first conductor disposed at a side of the end portion, and a second conductor superposed with the first conductor, and wherein the first conductor is inserted into the hole of the press-clamping member, and the second conductor disposed between the press-clamping member and the conductor press-clamping portion.

(7) The wire end portion-press fastening structure according to (2), wherein the double portion is inserted into the hole of the press-clamping member.

(8) The wire end portion-press fastening structure according to (6), wherein the press-clamping member includes an opening portion, so that the first conductor is directly held in contact with the second conductor.

One example of the press-clamping terminal, used in the invention, is a terminal which has at one end portion an electrical connecting portion of the male or the female type for electrical connection to a mating terminal of the female or the male type, and also has at the other end portion a conductor press-clamping portion to which the conductor is press-clamped in electrically-connected relation thereto.

In the wire end portion-press fastening structure of this invention, the press-clamping member has the function of stabilizing an electrical resistance without compressing the double portion. Therefore, during the time when the double portion is press-clamped by the press-fastening of the conductor press-fastening piece portion, a mechanical strength of the conductor is decreasing to a level lower than a breaking strength of the conductor. In contrast, the press-clamping member serves to increase the pressure of contact between the press-clamping terminal and the double portion. Namely, the double portion and the press-clamping member are electrically connected together with a large area of contact therebetween obtained, and the press-clamping member is electrically connected to the conductor press-clamping portion and the conductor press-fastening piece portion with a large area of contact therebetween obtained, and therefore the contact area increases, so that the electrical resistance decreases. Thus, the electrical resistance is decreased by increasing the contact area, and by doing so, the electrical performance is stabilized, so that the product of high quality can be obtained.

In the wire end portion-press fastening structure in this invention, by the press-fastening operation, the top plate or the bottom plate is electrically connected to the conductor press-clamping portion of the press-clamping terminal with a large area of contact therebetween obtained, and the bottom plate or the top plate is electrically connected to the conductor press-fastening piece portion of the press-clamping terminal with a large area of contact therebetween obtained. As a result, the double portion and the press-clamping terminal are electrically connected together with the large area of contact therebetween obtained.

In the wire end portion-press fastening structure of this invention, the press-clamping member is substantially equal in axial length to the conductor press-fastening piece portion, and therefore when the conductor press-fastening piece portion is press-fastened, the press-fastening force is applied to the press-clamping member uniformly over the entire length thereof, so that the area of contact between the press-clamping member and the double portion increases.

In the wire end portion-press fastening structure of this invention, when the conductor press-fastening piece portion is press-fastened to the top plate to be electrically connected thereto with a large area of contact therebetween obtained, the top plate is electrically connected to the one conductor portion with a large area of contact therebetween obtained, and also the one conductor portion is electrically connected to the bottom plate with a large area of contact therebetween obtained. At the same time, the bottom plate is electrically connected to the other conductor portion with a large area of contact therebetween obtained, and the other conductor portion is electrically connected to the conductor press-clamping portion with a large area of contact therebetween obtained. As a result, the double portion and the press-clamping terminal are electrically connected together with the large area of contact therebetween obtained.

In the wire end portion-press fastening structure of this invention, when the conductor press-fastening piece portion is press-fastened to the top plate to be electrically connected thereto with a large area of contact therebetween obtained, the top plate is electrically connected to the double portion with a large area of contact therebetween obtained, and also the double portion is electrically connected to the bottom plate with a large area of contact therebetween obtained, and the bottom plate is electrically connected to the conductor press-clamping portion with a large area of contact therebetween obtained. Therefore, the double portion is electrically connected to the press-clamping terminal with the large area of contact therebetween obtained, so that the electrical resistance is decreased by the increased contact area, and by doing so, the electrical performance is stabilized, so that the product of high quality can be obtained.

In the wire end portion-press fastening structure of this invention, when the conductor press-fastening piece portion is press-fastened to the top plate to be electrically connected thereto with a large area of contact therebetween obtained, the top plate is electrically connected to the one conductor portion with a large area of contact therebetween obtained, and also the one conductor portion and the other conductor portion are electrically connected together through the opening portion in the press-clamping member, with a large area of contact therebetween obtained, and the other conductor portion is electrically connected to the conductor press-clamping portion with a large area of contact therebetween obtained. Therefore, the double portion is electrically connected to the press-clamping terminal with the large area of contact therebetween obtained, so that the electrical resistance is decreased by the increased contact area, and by doing so, the electrical performance is stabilized, so that the product of high quality can be obtained.

The wire end portion-press fastening structure of the invention can solve the problem that the contact area is decreased, so that the electrical resistance increases, and therefore by decreasing the electrical resistance by the increased contact area, there is achieved an advantage that the electrical performance is stabilized, so that the product of high quality can be obtained.

DETAIL DESCRIPTION OF PREFERRED EMBODIMENTS

Figure 1:
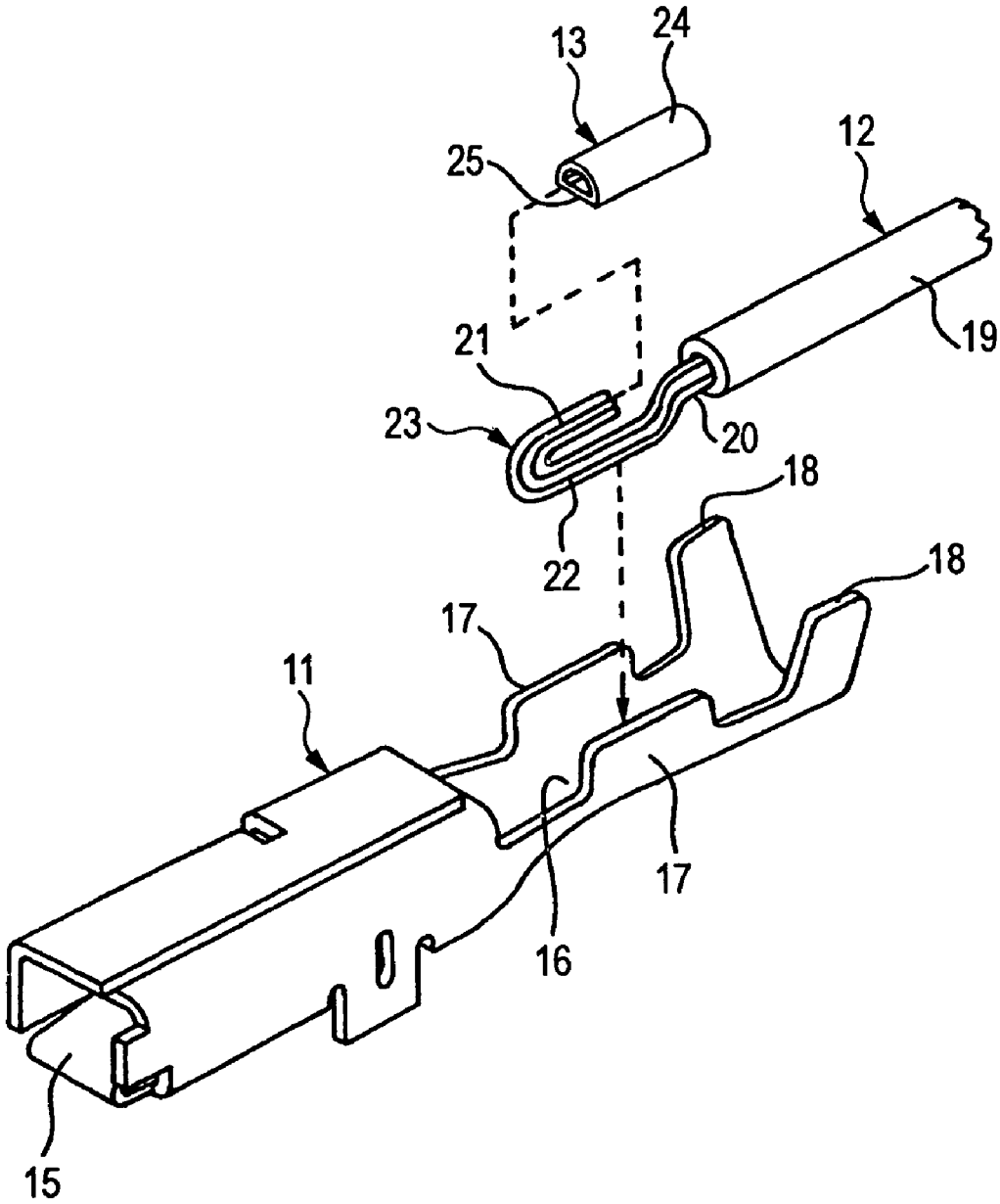
FIG. 1 is a perspective view of a first embodiment of a wire end portion-press fastening structure of the invention, showing various parts.
Figure 2:
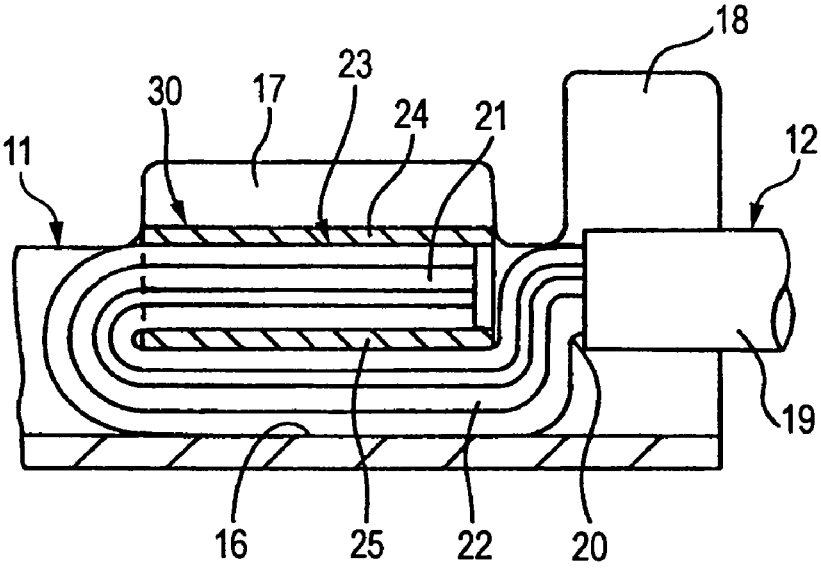
FIG. 2 is a cross-sectional view of the wire end portion-press fastening structure of FIG. 1, showing a condition in which a press-clamping member is mounted.
Figure 3:
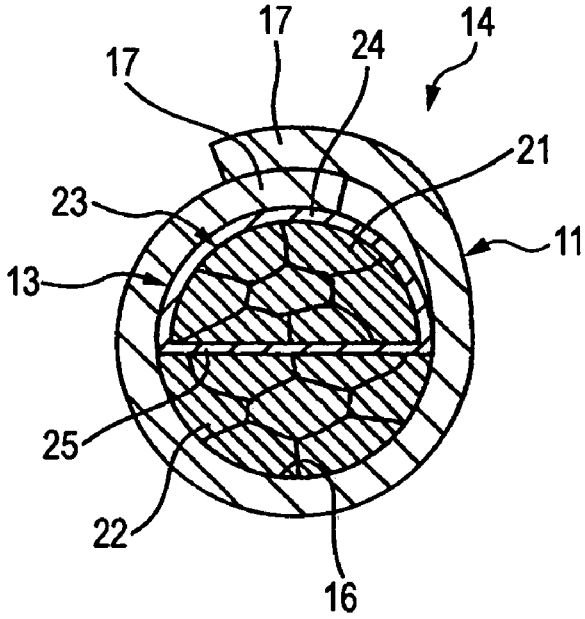
FIG. 3 is a cross-sectional view of a terminal-connected wire formed, using the wire end portion-press fastening structure of FIG. 1.
Figure 4:
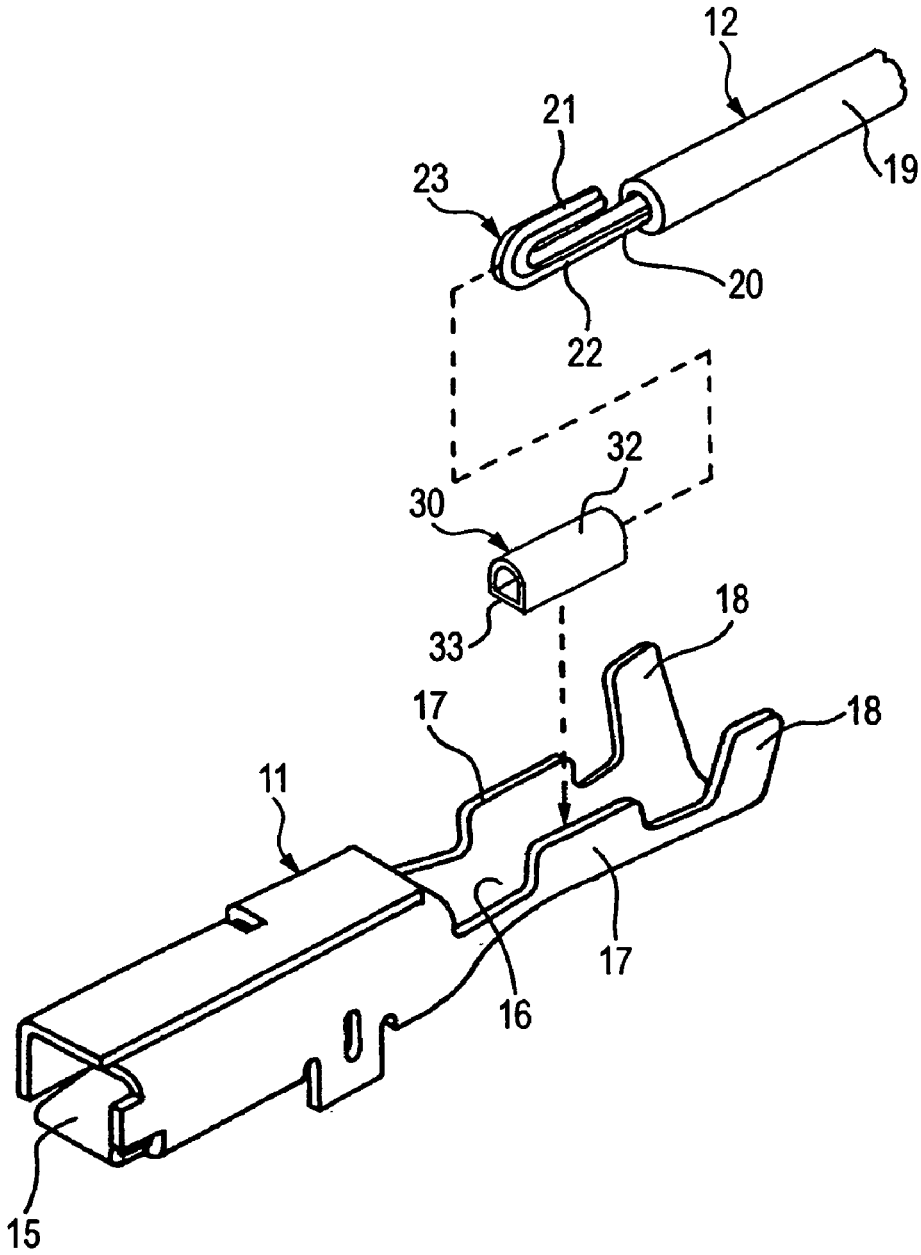
FIG. 4 is a perspective view of a second embodiment of a wire end portion-press fastening structure of the invention, showing various parts.
Figure 5:
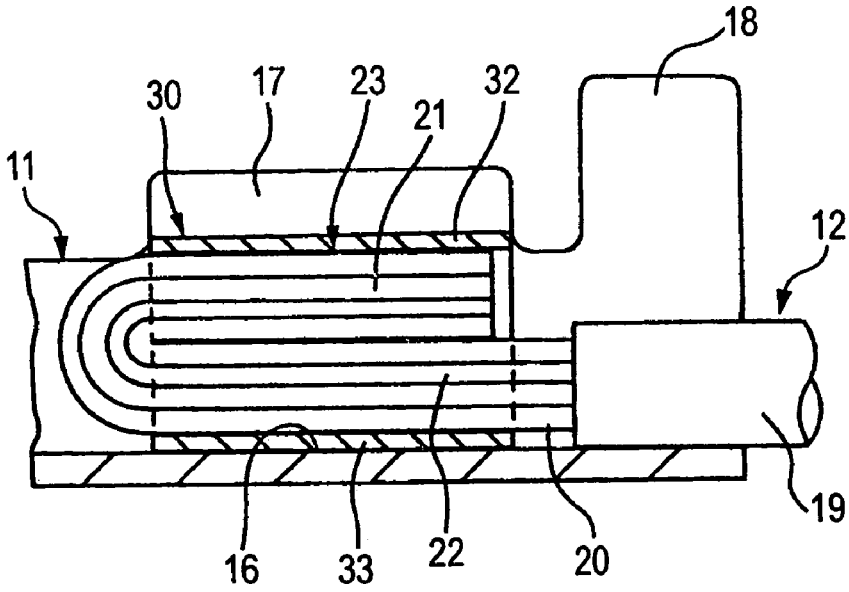
FIG. 5 is a cross-sectional view of the wire end portion-press fastening structure of FIG. 4, showing a condition in which a press-clamping member is mounted.
Figure 6:
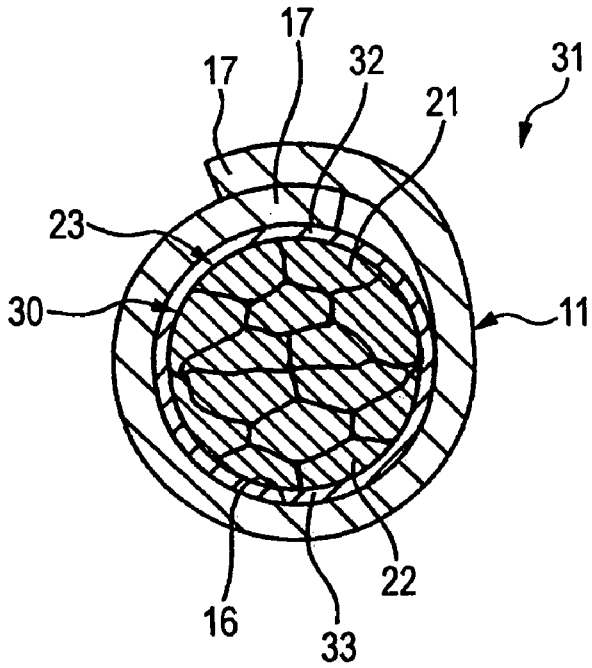
FIG. 6 is a cross-sectional view of a terminal-connected wire formed, using the wire end portion-press fastening structure of FIG. 4
Figure 7:
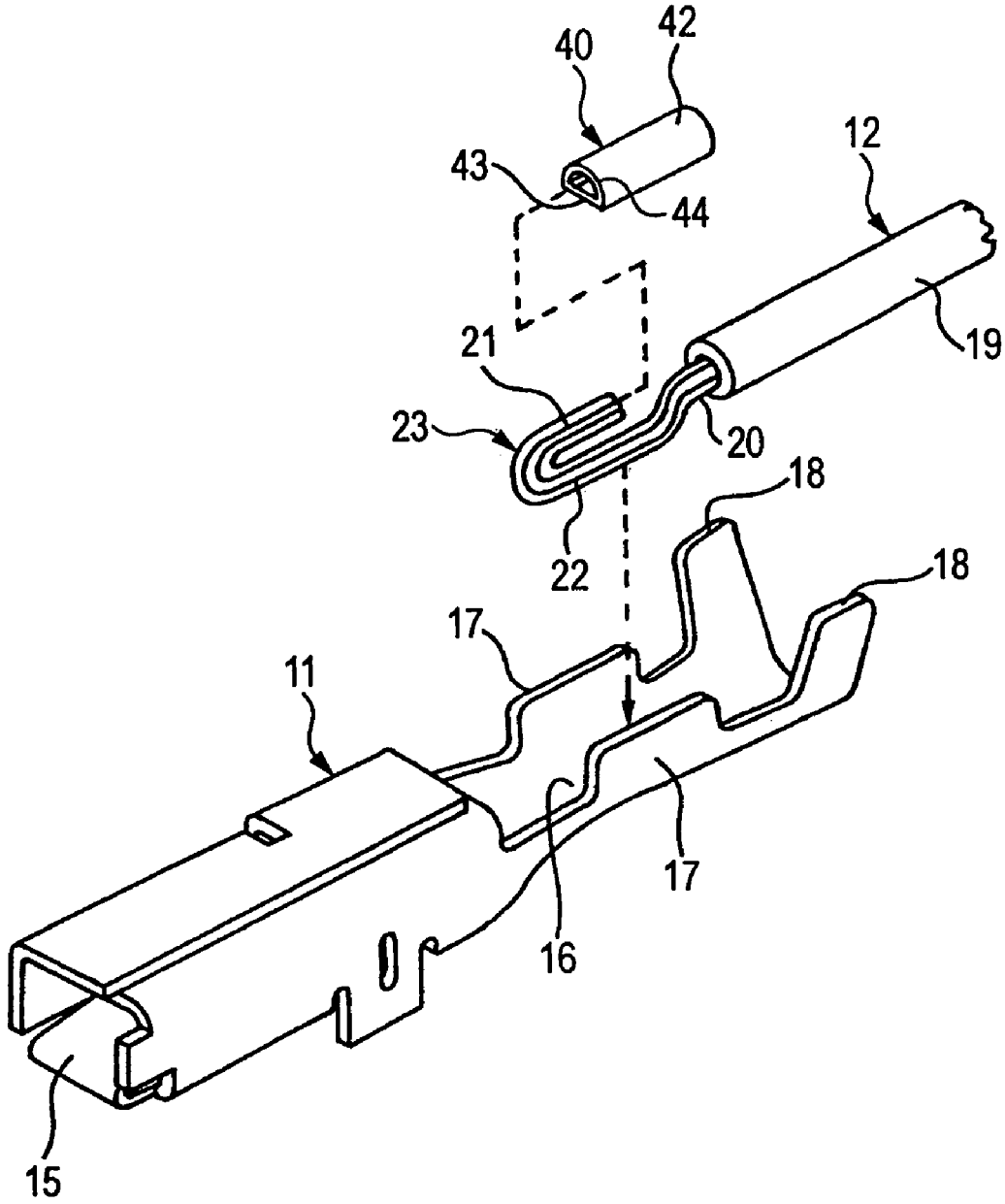
FIG. 7 is a perspective view of a third embodiment of a wire end portion-press fastening structure of the invention, showing various parts.
Figure 8:
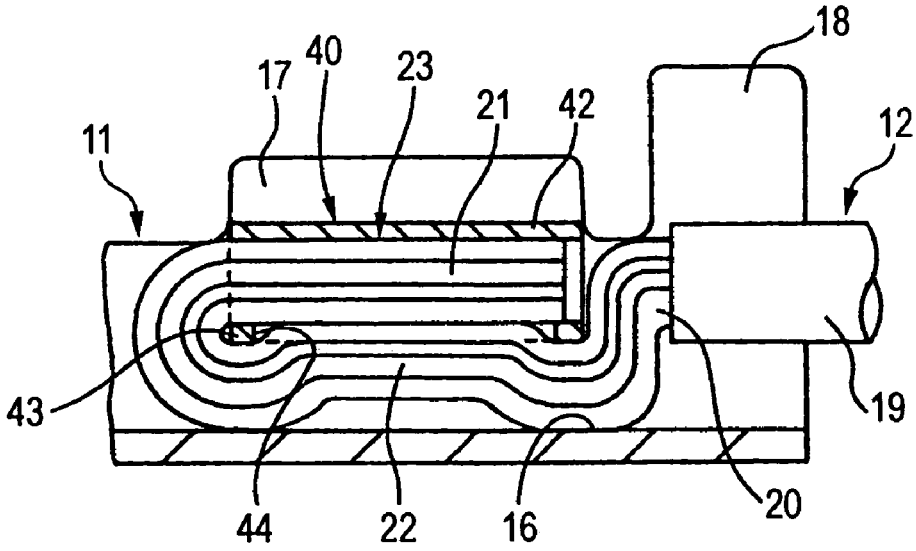
FIG. 8 is a cross-sectional view of the wire end portion-press fastening structure of FIG. 7, showing a condition in which a press-clamping member is mounted.
Figure 9:
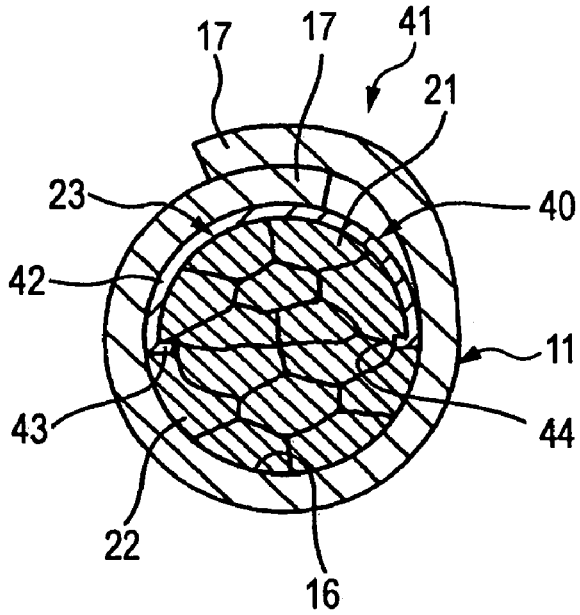
FIG. 9 is a cross-sectional view of a terminal-connected wire formed, using the wire end portion-press fastening structure of FIG. 7.
Figure 10:
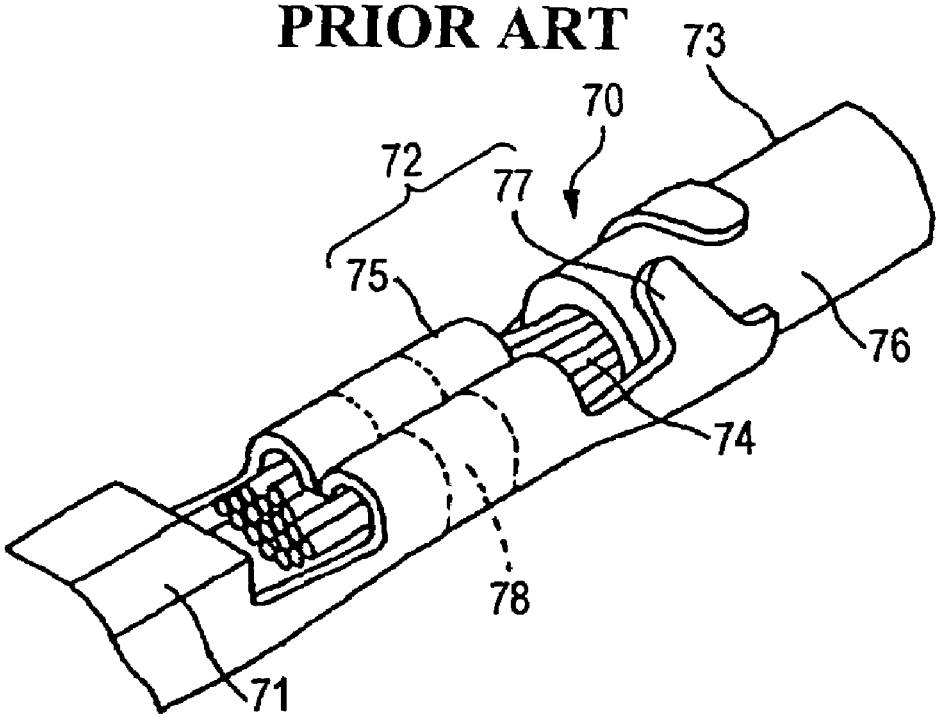
FIG. 10 PRIOR ART
FIG. 10 is a perspective view explanatory of a related wire end portion-press fastening structure.
Figure 11:
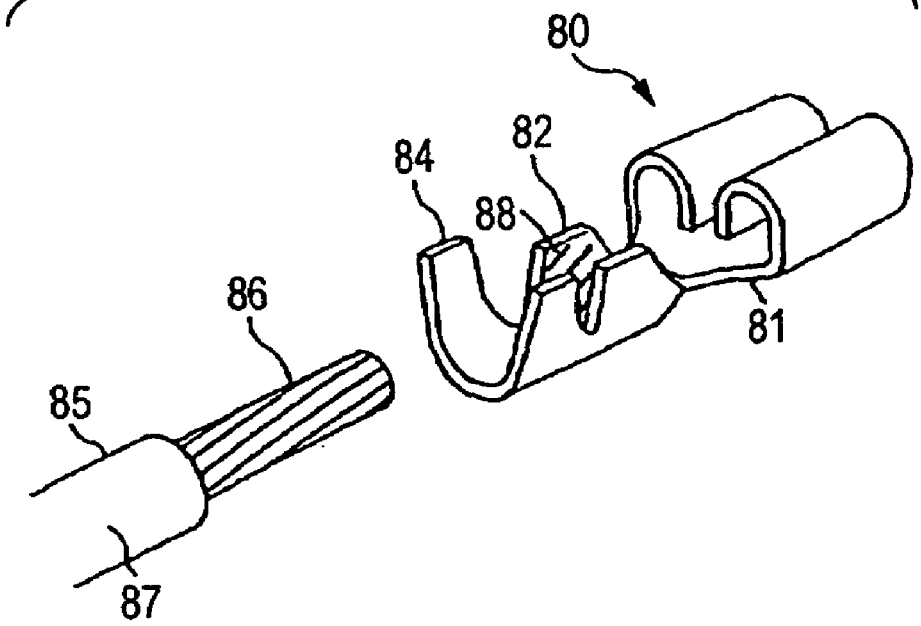
FIG. 11 PRIOR ART
FIG. 11 is a perspective view explanatory of a related wire end portion-press fastening structure different from the structure of FIG. 10.

A plurality of preferred embodiments of the present inventions will now be described in detail with reference to the drawings. FIG. 1 is a perspective view of a first embodiment of a wire end portion-press fastening structure of the invention, showing various parts, FIG. 2 is a cross-sectional view of the wire end portion-press fastening structure of FIG. 1, showing a condition in which a press-clamping member is mounted, FIG. 3 is a cross-sectional view of a terminal-connected wire formed, using the wire end portion-press fastening structure of FIG. 1, FIG. 4 is a perspective view of a second embodiment of a wire end portion-press fastening structure of the invention, showing various parts, FIG. 5 is a cross-sectional view of the wire end portion-press fastening structure of FIG. 4, showing a condition in which a press-clamping member is mounted, FIG. 6 is a cross-sectional view of a terminal-connected wire formed, using the wire end portion-press fastening structure of FIG. 4, FIG. 7 is a perspective view of a third embodiment of a wire end portion-press fastening structure of the invention, showing various parts, FIG. 8 is a cross-sectional view of the wire end portion-press fastening structure of FIG. 7, showing a condition in which a press-clamping member is mounted, and FIG. 9 is a cross-sectional view of a terminal-connected wire formed, using the wire end portion-press fastening structure of FIG. 7.

(First Embodiment)

As shown in FIG. 1, the first embodiment of the wire end portion-press fastening structure of the invention is designed to form the terminal-connected wire 14 (shown in FIG. 3), using a press-clamping terminal 11, the wire 12 and the press-clamping member 13.

The press-clamping terminal 11 is formed by bending a sheet of an electrically-conductive material such for example as a copper alloy, and this terminal 11 includes an electrical connecting portion 15 formed at one end portion thereof, a conductor press-clamping portion 16 and a pair of conductor press-fastening piece portions 17 which are formed at a central portion thereof, and a pair of sheath press-fastening piece portions 18 formed at the other end portion thereof. The electrical connecting portion 15 is formed into a male type or a female type, and is adapted to be electrically connected to a mating terminal of the female or the male type. The conductor press-clamping portion 16 has a U-shape transverse cross-section, and the pair of conductor press-fastening piece portions 17 project from upper edges of the conductor press-clamping portion 16, respectively. The sheath press-fastening piece portions 18 are formed on and project upwardly from the other end portion of the press-clamping terminal remote from an end of the conductor press-clamping portion 16.

The wire 12 includes a conductor 20 received within a sheath (covering portion) 19 and extending in an axial direction thereof. The conductor 20 is formed, for example by seven (7) aluminum wire elements (corresponding to a conductor of 0.35 sq. or 0.5 sq.). The conductor 20 is bent back to provide a double portion 23 defined by one conductor portion 21 and the other conductor portion 22 disposed in contiguous relation to each other.

The press-clamping member 13 is made of an electrically-conductive copper alloy, and includes a thin top plate 24 of a semi-cylindrical shape, and a thin bottom plate 25 of a flat plate-shape integrally connected to opposite side edges of the top plate 24. The press-clamping member 13 has the function of stabilizing an electrical resistance, developing between the double portion 23 and the press-clamping terminal 11, without compressing the double portion 23.

The one conductor portion 21 of the double portion 23 is passed through a space formed between the top plate 24 and bottom plate 25 of the press-clamping member 13, so that the bottom plate 25 is held between the one conductor portion 21 and the other conductor portion 22 in such a manner that the two conductor portions 21 and 22 are disposed symmetrically with respect to the bottom plate 25. The press-clamping member 13 is inserted into a groove portion of the press-clamping terminal 11 formed by the conductor press-clamping portion 16 and the conductor press-fastening piece portions 17, thereby press-clamping the other conductor portion 22 to the conductor press-clamping portion 16 of the press-clamping terminal 11. Here, the double portion 23 is formed by the conductor portions 21 and 22 which is disposed in contiguous relation to each other as a result of bending the conductor 20, and therefore if each conductor portions is 0.35 sq, then the double portion 23 corresponds to a conductor of 0.7 sq.

When the conductor press-fastening piece portions 17 are press-fastened to the top plate 24 of the press-clamping member 13, the conductor press-fastening piece portions 17 are electrically connected to the top plate 24 in such a manner that a large area of contact therebetween is obtained. Also, the one conductor portion 21 is electrically connected to the bottom plate 25 with a large area of contact therebetween obtained, and the bottom plate 25 is electrically connected to the other conductor portion 22 with a large area of contact therebetween obtained, and the other conductor portion 22 is electrically connected to the conductor press-clamping portion 16 with a large area of contact therebetween obtained. Thus, the double portion 23 and the conductor press-clamping portion 16 are electrically connected together with the large area of contact therebetween obtained. Here, during the time when the press-clamping member 13 is pressed by the conductor press-fastening piece portions 17 to be press-clamped to the double portion 23, a mechanical strength of the conductor 20 is decreasing to a level lower than a breaking strength of the conductor. In contrast, the press-clamping member 13 serves to increase the pressure of contact between the conductor press-clamping portion 16 and the double portion 23, and therefore the area of contact therebetween increases, so that the electrical resistance decreases. Thus, the electrical resistance is decreased by the increased contact area, and by doing so, the electrical performance is stabilized, so that the terminal-connected wire 14 of high quality can be obtained.

As shown in FIG. 2, an axial length L2 of the press-clamping member 13 is substantially equal to an axial length L1 of the conductor press-fastening piece portions 17. Since the press-clamping member 13 is equal in length to the conductor press-fastening piece portions 17, the press-clamping member 13 receives a press-fastening force from the conductor press-fastening piece portions 17 uniformly over the entire length thereof, and therefore can apply a uniform press-clamping force to the double portion 23.

As shown in FIG. 3, when the conductor press-fastening piece portions 17 are press-fastened by a press-fastening jig (not shown), the conductor press-fastening piece portions 17 are deformed, so that their distal end portions are curved to overlap each other. Thus, the press-fastening piece portions 17 are subjected to so-called lap-crimping, and press the top plate 24 of the press-clamping member 13 toward the conductor press-clamping portion 16. As a result, the one conductor portion 21, the bottom plate 25 and the other conductor portion 22 are pressed toward the conductor press-clamping portion 16, and therefore the conductor press-fastening piece portions 17 are electrically connected to the top plate 24 with the large area of contact therebetween obtained, and also the top plate 24 is electrically connected to the one conductor portion 21 with the large area of contact therebetween obtained, and the one conductor portion 21 is electrically connected to the bottom plate 25 with the large area of contact therebetween obtained, and the bottom plate 25 is electrically connected to the other conductor portion 22 with the large area of contact therebetween obtained, and the other conductor portion 22 is electrically connected to the conductor press-clamping portion 16 with the large area of contact therebetween obtained. Then, the sheath press-fastening piece portions 18 are press-fastened to the sheath 19.

In the wire end portion-press fastening structure of the first embodiment, the press-clamping member 13 has the function of stabilizing the electrical resistance without compressing the double portion 23, and therefore the during the time when the double portion 23 is press-clamped by the press-fastening of the conductor press-fastening piece portions 17, the mechanical strength of the conductor 20 is decreasing to a level lower than the breaking strength of the conductor. In contrast, the pressure of contact between the press-clamping terminal 11 and the double portion 23 increases thanks to the provision of the press-clamping member 13. Namely, the double portion 23 and the press-clamping member 13 are electrically connected together with the large area of contact therebetween obtained, and the press-clamping member 13 is electrically connected to the conductor press-clamping portion 16 and the conductor press-fastening piece portions 17 with the large area of contact therebetween obtained, and therefore the electrical resistance can be decreased by the increased contact area. Thus, the electrical resistance is decreased by increasing the contact area, and by doing so, the electrical performance is stabilized, so that the product of high quality can be obtained.

In the wire end portion-press fastening structure of the first embodiment, by the press-fastening operation, the bottom plate 25 is electrically connected to the conductor press-clamping portion 16 of the press-clamping terminal 11 with the large area of contact therebetween obtained, and the top plate 24 is electrically connected to the conductor press-fastening piece portions 17 with the large area of contact therebetween obtained. As a result, the double portion 23 and the press-clamping terminal 11 are electrically connected together with the large area of contact therebetween obtained.

In the wire end portion-press fastening structure of the first embodiment, the press-clamping member 13 has the axial length substantially equal to the axial length of the conductor press-fastening piece portions 17, and therefore the press-fastening force is applied to the press-clamping member 13 over the entire length thereof, so that the area of contact between the press-clamping member 13 and the double portion 23 increases.

In the wire end portion-press fastening structure of the first embodiment, when the conductor press-fastening piece portions 17 are press-fastened to the top plate 24 to be electrically connected thereto with the large area of contact therebetween obtained, the top plate 24 is electrically connected to the one conductor portion 21 with the large area of contact therebetween obtained, and also the one conductor portion 21 is electrically connected to the bottom plate 25 with the large area of contact therebetween obtained. At the same time, the bottom plate 25 is electrically connected to the other conductor portion 22 with the large area of contact therebetween obtained, and also the other conductor portion 22 is electrically connected to the conductor press-clamping portion 16 with the large area of contact therebetween obtained. As a result, the double portion 23 and the press-clamping terminal 11 are electrically connected together with the large area of contact therebetween obtained.

(Second Embodiment)

Next, the second embodiment of the invention will be described with reference to FIGS. 4 to 6. In each of the second and subsequent embodiments, those members, etc., similar in construction and function to the already-described members, etc., will be designated by identical or like reference numerals in the drawings, and explanation thereof will be made briefly or omitted.

As shown in FIG. 4, the wire end portion-press fastening structure of the second embodiment is designed to form the terminal-connected wire 31 (shown in FIG. 6), using a press-clamping terminal 11, the wire 12 and the press-clamping member 30.

Although like the press-clamping member 13 of the first embodiment, the press-clamping member 30 includes a top plate 32 and a bottom plate 33, a space, formed by the top plate 32 and the bottom plate 33, is larger than the space in the press-clamping member 13 of the first embodiment.

A double portion 23 is inserted into the space formed between the top plate 32 and bottom plate 33 of the press-clamping member 30, so that the double portion 23 is held between the top plate 32 and the bottom plate 33. The press-clamping member 30 is inserted into a groove portion of the press-clamping terminal 11 formed by a conductor press-clamping portion 16 and conductor press-fastening piece portions 17, thereby press-clamping the bottom plate 33 to the conductor press-clamping portion 16 of the press-clamping terminal 11.

When the conductor press-fastening piece portions 17 are press-fastened to the top plate 32 of the press-clamping member 30 to be electrically connected thereto with a large area of contact therebetween is obtained, and also the top plate 32 is electrically connected to the double portion 23 with a large area of contact therebetween obtained, and the double portion 23 is electrically connected to the bottom plate 33 with a large area of contact therebetween obtained, and the bottom plate 33 is electrically connected to the conductor press-clamping portion 16 with a large area of contact therebetween obtained. Thus, the double portion 23 and the conductor press-clamping portion 16 are electrically connected together with the large area of contact therebetween obtained. Here, during the time when the press-clamping member 30 is pressed by the conductor press-fastening piece portions 17 to be press-clamped to the double portion 23, a mechanical strength of the conductor 20 is decreasing to a level lower than a breaking strength of the conductor. In contrast, the press-clamping member 30 serves to increase the pressure of contact between the conductor press-clamping portion 16 and the double portion 23, and therefore the area of contact therebetween increases, so that the electrical resistance decreases. Thus, the electrical resistance is decreased by increasing the contact area, and by doing so, the electrical performance is stabilized, so that the terminal-connected wire 31 of high quality can be obtained.

As shown in FIG. 5, an axial length L2 of the press-clamping member 30 is substantially equal to an axial length L1 of the conductor press-fastening piece portions 17, and therefore the press-clamping member 30 receives a press-fastening force from the conductor press-fastening piece portions 17 uniformly over the entire length thereof, and therefore can apply a uniform press-clamping force to the double portion 23.

As shown in FIG. 6, when the conductor press-fastening piece portions 17 are press-fastened by a press-fastening jig (not shown), the conductor press-fastening piece portions 17 are deformed, so that their distal end portions are curved to overlap each other. Thus, the press-fastening piece portions 17 are subjected to so-called lap-crimping, and press the top plate 32 of the press-clamping member 30 toward the conductor press-clamping portion 16. As a result, the double portion 23 and the bottom plate 33 are pressed toward the conductor press-clamping portion 16, and therefore the conductor press-fastening piece portions 17 are electrically connected to the top plate 32 with the large area of contact therebetween obtained, and also the top plate 32 is electrically connected to the double portion 23 with the large area of contact therebetween obtained, and the double portion 23 is electrically connected to the bottom plate 33 with the large area of contact therebetween obtained, and the bottom plate 33 is electrically connected to the conductor press-clamping portion 16 with the large area of contact therebetween obtained. At this time, one conductor portion 21 and the other conductor portion 22 of the double portion 23 are electrically connected together within the press-clamping member 30, with a large area of contact therebetween obtained. Then, sheath press-fastening piece portions 18 are press-fastened to a sheath 19.

In the wire end portion-press fastening structure of the second embodiment, when the conductor press-fastening piece portions 17 are press-fastened to the top plate 32 to be electrically connected thereto with the large area of contact therebetween obtained, the top plate 32 is electrically connected to the double portion 23 with the large area of contact therebetween obtained, and also the double portion 23 is electrically connected to the bottom plate 33 with the large area of contact therebetween obtained, and the bottom plate 33 is electrically connected to the conductor press-clamping portion 16 with the large area of contact therebetween obtained. As a result, the double portion 23 and the press-clamping terminal 11 are electrically connected together with the large area of contact therebetween obtained, and therefore the electrical resistance is decreased by increasing the contact area, and by doing so, the electrical performance is stabilized, so that the product of high quality can be obtained.

(Third Embodiment)

Next, the third embodiment of the invention will be described with reference to FIGS. 7 to 9.

As shown in FIG. 7, a wire end portion-press fastening structure of the third embodiment is designed to form the terminal-connected wire 41 (shown in FIG. 9), using a press-clamping terminal 11, the wire 12 and the press-clamping member 40.

Although like the press-clamping member 13 of the first embodiment, the press-clamping member 40 includes a top plate 42 and a bottom plate 43, an opening portion 44 for enabling one conductor portion 21 and other conductor portion 22 to contact each other is formed in the bottom plate 43.

The one conductor portion 21 of a double portion 23 is passed through a space formed between the top plate 42 and bottom plate 43 of the press-clamping member 40, so that the one conductor portion 21 is contacted with the other conductor portion 22 through the opening portion 44, and therefore is electrically connected thereto. The press-clamping member 40 is inserted into a groove portion of the press-clamping terminal 11 formed by a conductor press-clamping portion 16 and conductor press-fastening piece portions 17, thereby press-clamping the other conductor portion 22 to the conductor press-clamping portion 16 of the press-clamping terminal 11.

When the conductor press-fastening piece portions 17 are press-fastened to the top plate 42 of the press-clamping member 40, the conductor press-fastening piece portions 17 are electrically connected to the top plate 42 with a large area of contact therebetween obtained, and the top plate 42 is electrically connected to the one conductor portion 21 with a large area of contact therebetween obtained. Also, the one conductor portion 21 and the other conductor portion 22 are electrically connected together through the opening portion 44, with a large area of contact therebetween obtained, and the other conductor 22 is electrically connected with the conductor press-clamping portion 16 with a large area of contact therebetween obtained. Thus, the double portion 23 and the conductor press-clamping portion 16 are electrically connected together with the large area of contact therebetween obtained. Here, during the time when the press-clamping member 40 is pressed by the conductor press-fastening piece portions 17 to be press-clamped to the double portion 23, a mechanical strength of the conductor 20 is decreasing to a level lower than a breaking strength of the conductor. In contrast, the press-clamping member 40 serves to increase the pressure of contact between the conductor press-clamping portion 16 and the double portion 23, and therefore the area of contact therebetween increases, so that the electrical resistance decreases. Thus, the electrical resistance is decreased by increasing the contact area, and by doing so, the electrical performance is stabilized, so that the terminal-connected wire 41 of high quality can be obtained.

As shown in FIG. 8, an axial length L2 of the press-clamping member 40 is substantially equal to an axial length L1 of the conductor press-fastening piece portions 17, and therefore the press-clamping member 40 receives a press-fastening force from the conductor press-fastening piece portions 17 uniformly over the entire length thereof, and therefore can apply a uniform press-clamping force to the one and other conductor portions 21 and 22 of the double portion 23.

As shown in FIG. 9, when the conductor press-fastening piece portions 17 are press-fastened by a press-fastening jig (not shown), the conductor press-fastening piece portions 17 are deformed, so that their distal end portions are curved to overlap each other. Thus, the press-fastening piece portions 17 are subjected to so-called lap-crimping, and press the top plate 42 of the press-clamping member 40 toward the conductor press-clamping portion 16. As a result, the one conductor portion 21 is pressed toward the conductor press-clamping portion 16, and the other conductor portion 22 is pressed toward the conductor press-clamping portion 16 through the opening 44, and therefore the conductor press-fastening piece portions 17 are electrically connected to the top plate 42 with the large area of contact therebetween obtained, and also the top plate 42 is electrically connected to the double portion 23 with the large area of contact therebetween obtained, and the double portion 23 is electrically connected to the conductor press-clamping portion 16 with the large area of contact therebetween obtained. With respect to the double portion 23, the one and other conductor portions 21 and 22 are directly electrically connected together with the large area of contact therebetween obtained. Then, sheath press-fastening piece portions 18 are press-fastened to a sheath 19.

In the wire end portion-press fastening structure of the third embodiment, when the conductor press-fastening piece portions 17 are press-fastened to the top plate 42 to be electrically connected thereto with the large area of contact therebetween obtained, the top plate 42 is electrically connected to the one conductor portion 21 with the large area of contact therebetween obtained, and also the one conductor portion 21 and the other conductor portion 22 are electrically connected together through the opening portion 44 in the press-clamping member 40, with the large area of contact therebetween obtained, and the other conductor portion 22 is electrically connected to the conductor press-clamping portion 16 with the large area of contact therebetween obtained. As a result, the double portion 23 and the press-clamping terminal 11 are electrically connected together with the large area of contact therebetween obtained, and therefore the electrical resistance is decreased by increasing the contact area, and by doing so, the electrical performance is stabilized, so that the product of high quality can be obtained.

The present invention is not limited to the above embodiments, and suitable modifications, improvements and so on can be made. For example, the number of the wire elements of the conductor of the wire, the diameter of the conductor and the diameter of the groove portion of the press-clamping terminal are determined in accordance with the design of a circuit to which the terminal-connected wire is applied, and accordingly the diameter of the press-clamping member is determined.

The material of which the press-clamping member is made is not limited to the copper alloy, and any other suitable metal or resin, which is electrically conductive and deformable can be used.

In order that the shaping of the press-clamping member can be effected easily, the press-clamping member can be formed into a D-shaped transverse cross-section.

What is claimed is:

1. A wire end portion-press fastening structure comprising:

a wire that includes a conductor, wherein an end portion of the conductor is bent back so as to provide a double portion;

a press-clamping terminal, the press-clamping terminal comprising:

a conductive press-clamping terminal body;

an electrical connecting portion that is disposed at an end portion of the press-clamping terminal body, and is connected to a mating terminal;

a conductor press-clamping portion that is deposed at a portion corresponding to the double portion; and conductor press-fastening piece portions that are extended from opposite sides of the conductor press-clamping portion in an axial direction; and a conductive press-clamping member that is held in contact with the conductor, wherein the conductor press-fastening piece portions are press-fastened to the press-clamping member, so that the double portion is electrically connected to the conductor press-clamping portion through the press-clamping member.

2. The wire end portion-press fastening structure according to claim 1, wherein the press-clamping member has a hole and a pipe shape.

3. The wire end portion-press fastening structure according to claim 1, wherein the press-clamping member includes a top plate that has a generally semi-cylindrical shape, and a bottom plate that is integrally connected to opposite side edges of the top plate.

4. The wire end portion-press fastening structure according to claim 1, wherein an axial length of the press-clamping member is substantially equal to an axial length of the conductor press-fastening piece portion.

5. The wire end portion-press fastening structure according to claim 1, wherein the wire includes a sheath that covers the conductor, and the press-clamping terminal includes sheath press-fastening piece portions that are extended from opposite sides of a portion opposed to the electrical connecting portion of the press-clamping terminal body in the axial direction, and wherein the sheath press-fastening piece portions are press-fastened to the sheath.

6. The wire end portion-press fastening structure according to claim 2, wherein the double portion includes a first conductor disposed at a side of the end portion, and a second conductor superposed with the first conductor, and wherein the first conductor is inserted into the hole of the press-clamping member, and the second conductor disposed between the press-clamping member and the conductor press-clamping portion.

7. The wire end portion-press fastening structure according to claim 2, wherein the double portion is inserted into the hole of the press-clamping member.

8. The wire end portion-press fastening structure according to claim 6, wherein the press-clamping member includes an opening portion, so that the first conductor is directly held in contact with the second conductor.

* * * * *